US007614446B2

(12) United States Patent
Walker

(10) Patent No.: US 7,614,446 B2
(45) Date of Patent: Nov. 10, 2009

(54) SWIVELLING DEVICE FOR A DOWNHOLE ROD PUMP

(75) Inventor: Lloyd Walker, Swift Current (CA)

(73) Assignee: Topco Oilsite Products Ltd., Calgary (CA)

( * ) Notice: Subject to any disclaimer, the term of this patent is extended or adjusted under 35 U.S.C. 154(b) by 0 days.

(21) Appl. No.: 11/797,501

(22) Filed: May 3, 2007

(65) Prior Publication Data

US 2007/0256866 A1 Nov. 8, 2007

(51) Int. Cl.
*E21B 19/00* (2006.01)

(52) U.S. Cl. ..... 166/75.14; 166/85.1

(58) Field of Classification Search ..... 166/85.1, 166/77.51, 378, 379, 380, 75.14, 301, 403; 175/202; 403/166; 294/82.16, 82.15, 82.1, 294/82.24

See application file for complete search history.

(56) References Cited

U.S. PATENT DOCUMENTS 2,075,426 A * 3/1937 Church ..... 285/36
2,693,980 A * 11/1954 Heidman, Jr. ..... 294/82.28
4,403,666 A * 9/1983 Willis ..... 175/85
6,253,844 B1 7/2001 Walker

* cited by examiner

*Primary Examiner*—David J. Bagnell
*Assistant Examiner*—Cathleen R Hutchins
(74) *Attorney, Agent, or Firm*—Bennett Jones LLP

(57) ABSTRACT

A swivelling device is provided for picking up or backing off a drive string after it has been stuck in a down hole. The device allows the drive string to move longitudinally and rotate. The device has a shaft rotatably mounted in a housing so that the shaft can freely rotate but can not move radially or axially relative to the housing. A frame support is moveably connected to the housing and has an aperture that is attachable to a support system capable of lifting up the drive string. A pair of biasing mechanisms bias the housing towards the frame support. When a downward force is applied to the shaft by the drive string, the housing can be displaced downwards away from the support frame. Once the downward force ceases, the biasing mechanism moves the housing back towards the support frame.

11 Claims, 3 Drawing Sheets

SWIVELLING DEVICE FOR A DOWNHOLE ROD PUMP

This invention is in the field of devices for releasing stuck drive strings in a downhole and more particularly to a device that absorbs longitudinal motion and rotational motion of a drive string while the drive string is becoming unstuck.

BACKGROUND

Downhole rod pumps, such as rotary pumps and stroke pumps, for extracting oil from an oil well are typically driven by a drive string extending down the downhole of the oil well. The drive string is a number of sections of tubes or rods connected end to end and passing down the downhole. Because the downhole can be quite deep, the drive string can be made up of numerous sections of these tubes or rods.

Progressive cavity pumps, one type of rotary pump, has a stator attached to the end of the production tubing lining the downhole and a corkscrew-shaped rotor attached to a bottom end of the drive string at the bottom of the downhole. The top end of the drive string is connected to a polish rod. The polish rod has a smooth outer surface to correspond with an inside surface of the production tubing lining the downhole and the top end of the polish rod connects to a drive unit. The drive unit rotates the polish rod and the drive string. Progressive cavity pumps are operative to pump fluid up the down hole by using the drive unit to rotate the polish rod which in turn rotates the drive string and the corkscrew-shaped rotor attached at the bottom end of the drive string. This rotation of the corkscrew-shaped rotor forces fluid up the annulus formed between the drive string and the inner surface of the production tubing, lining the downhole, and up to the ground surface.

During pumping, the downhole end of the drive string can become jammed by accumulation of debris, high viscosity of the medium being pumped, or obstructions in the downhole. When the drive string becomes jammed, the drive string at the end of the downhole stops rotating. The drive string continues to rotate a bit, twisting the drive string all the way up the downhole until the polish rod connected to the end of the drive string applies enough torsional force to the drive unit to trigger overload sensors in the drive unit. When the overload sensors trigger the drive unit to shut down, the drive unit typically includes a braking system that controllably releases torsion built up in the twisted drive string by "back spinning" the polish rod and the drive string in a controlled fashion using the braking system.

It is this twisting of the top end of the drive string while the bottom end of the drive string is stuck that causes torsional forces to build up in the drive string. Due to the fact that the drive string can be quite long, substantial torsional forces can be built up in the drive string when the bottom end of the drive string becomes jammed.

The braking system in theory should remove all this built up torsional force however it does not always release all of the torsional force stored up in the drive string. Often additional torsional force must be released by "picking up" the drive string. To "pick up" the drive string, the drive unit is disconnected from the polish rod, and the polish rod and attached drive string is pulled up the downhole a few centimeters. This releases the stuck drive string and can cause stored up torsional forced to suddenly release in an "uncontrolled" manner by the polish rod and attached drive string back spinning until the drive string is once again untwisted.

This "picking up" is typically done by attaching a device to the polish rod that can be attached to a support system, capable of lifting the drive string, and still allow the polish rod and the attached drive string to rotate. A conventional method uses a pony rod, a rod elevator and a rod hook for a device. The pony rod, rod elevator and rod hook are attached to the polish rod and the rod hook has a swivel which allows it to rotate with the polish rod and drive string, allowing the string to back spin and release the built up torsional forces. The polish rod and drive string are pulled a short distance up the downhole, attached to the swivelling hook, and any built up torsional force is released causing the drive string and polish rod to swivel on the hook.

Previously these hooks were often not symmetrical around their axis which caused "wobbling" as the drive string spun. Additionally, the way the hook attaches to the polish rod often results in a loose connection which allows the polish rod to move radially while it is attached to the hook. This "wobbling" is hard on the devices and can result in failure of the device which can cause damage to surrounding equipment and even physically injure workers nearby.

Stroke pumps are also commonly used to pump oil from an oil well. Stroke pumps use a pump attached at the end of the drive string to pump fluid up the downhole. Rather than rotating the drive string, the drive string is driven up and down inside the down hole to force fluid up the downhole to the ground surface. A drive unit and lever system is attached to the polish rod, which in turn is attached to the drive string. The lever system pushes and pulls the polish rod up and the attached drive string up and down the downhole to cause the pumping action.

However, stroke pumps can also become stuck in the downhole. If a stroke pump becomes stuck, the drive string must be stripped out of the downhole in order to remove the drive string from the downhole. However, as the drive string becomes freed by backing it off, the drive string can suddenly twist or jerk longitudinally in the downhole. This jerking or jumping can be quite violent and may damage the equipment being used or even injure people who are nearby.

U.S. Pat. No. 6,253,844 to Walker discloses a swivelling device for a downhole rod pump for releasing torsional forces on a drive string in an "uncontrolled" manner. The device uses a rod with a threaded end to connect to a mating thread on the polishing rod. This connecting of a threaded end of a rotating shaft to a corresponding threaded end of a polish rod causes the polish rod to rotate around the center of axis of the device, greatly reducing the chance that wobble will occur in the drive string as the drive string back spins to release built up torsional forces.

The device taught in U.S. Pat. No. 6,253,844 also uses a shock mechanism to allow the device to also handle longitudinal force placed on the swivelling device as it back spins or, if the device is being used with a stroke pump to dislodge a stuck drive string, absorb sudden jerks the drive string caused by the drive string coming unstuck. The shock mechanism uses a spring placed inside the housing and surrounding the rotating shaft. The shaft can therefore move longitudinally relative to the housing the spring to absorb any longitudinal motion. However, in order for the device to function, either the shaft or bearing supporting the shaft must slide relative to the housing which can prematurely wear the bearing and limit the size and type of bearings that can be used.

SUMMARY OF THE INVENTION

It is an object of the present invention to provide a device for releasing a stuck drive string that overcomes problems in the prior art.

In a first aspect, a swivelling device for connection to a drive string is provided. The device comprises: a housing having an opening in a bottom end; a shaft mounted within the housing and defining an axis, the shaft rotatably mounted within the housing and fixed longitudinally relative to the housing, a bottom end of the shaft passing through the opening in the bottom end of the housing and connectable to a drive string with no point of articulation between the shaft and the drive string; a support frame connectable to an external support, the support frame moveably connected to the housing such that the housing can be longitudinally displaced, along the axis, away from the support frame; and at least one biasing mechanism biasing the housing towards the support frame.

In a second aspect, a swivelling device for connection to a drive string is provided. The device comprises: a housing having an opening in a bottom end; a shaft mounted within the housing a first bearing and a second bearing and defining an axis, the first bearing positioned towards the bottom end of the housing and suitable to support a radial load imposed on the first bearing by the shaft, the second bearing being a thrust bearing and positioned at a top end of the shaft preventing downward motion of the shaft relative to the second bearing such that downward motion of the shaft causes the housing to move downwards in conjunction with the shaft, a bottom end of the shaft passing through the opening in the bottom end of the housing and connectable to a drive string with no point of articulation between the shaft and the drive string; a support frame connectable to an external support, the support frame moveably connected to the housing such that the housing can be longitudinally displaced, along the axis, away from the support frame; and at least two biasing mechanisms biasing the housing towards the support frame, the two biasing mechanisms positioned on substantially opposing sides of the housing In a third aspect, a swivelling device for connection to a drive string is provided. The device comprises: a housing having an opening in a bottom end; a shaft mounted within the housing and defining an axis, the shaft rotatably mounted within the housing and fixed longitudinally relative to the housing, a bottom end of the shaft passing through the opening in the bottom end of the housing and connectable to a drive string with no point of articulation between the shaft and the drive string; a support frame connectable to an external support, the support frame moveably connected to the housing such that the housing can be longitudinally displaced, along the axis, away from the support frame; and at least two coil springs, each coil spring positioned within a sleeve connected an outside surface of the housing and biasing the housing towards the support frame.

In an aspect, a device is provided for allowing a drive string to move longitudinally and rotate as it is being picked up or backed off. The device has a shaft rotatably mounted in a housing so that the shaft can freely rotate but can not move radially or axially relative to the housing. A pair of biasing mechanisms comprising springs are located on each side of the housing and are attached at a top end to a frame support. The frame support has an aperture to be attachable to a support system capable of lifting up the drive string.

The biasing mechanisms allow the housing containing the rotating shaft to move relative to the frame support. In this way longitudinal motion such as sudden upward or downward jerks of the drive string that places force on the shaft is transferred to the housing, without requiring the shaft to slide in one or more of the bearing and subject the bearing surfaces to frictional forces between the shaft and the bearings or the bearings and the housing. The housing can move relative to the frame support using the biasing mechanism and the biasing mechanisms therefore absorb longitudinal forces placed on the shaft by the drive string.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
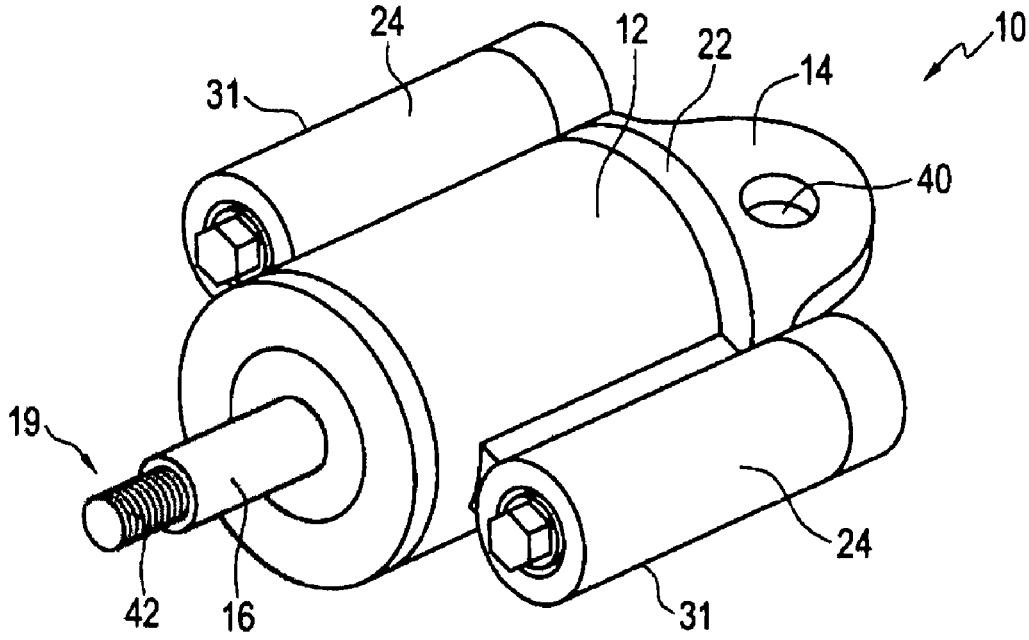
FIG. 1 is a bottom perspective view of the device, in accordance with the present invention.
Figure 2:
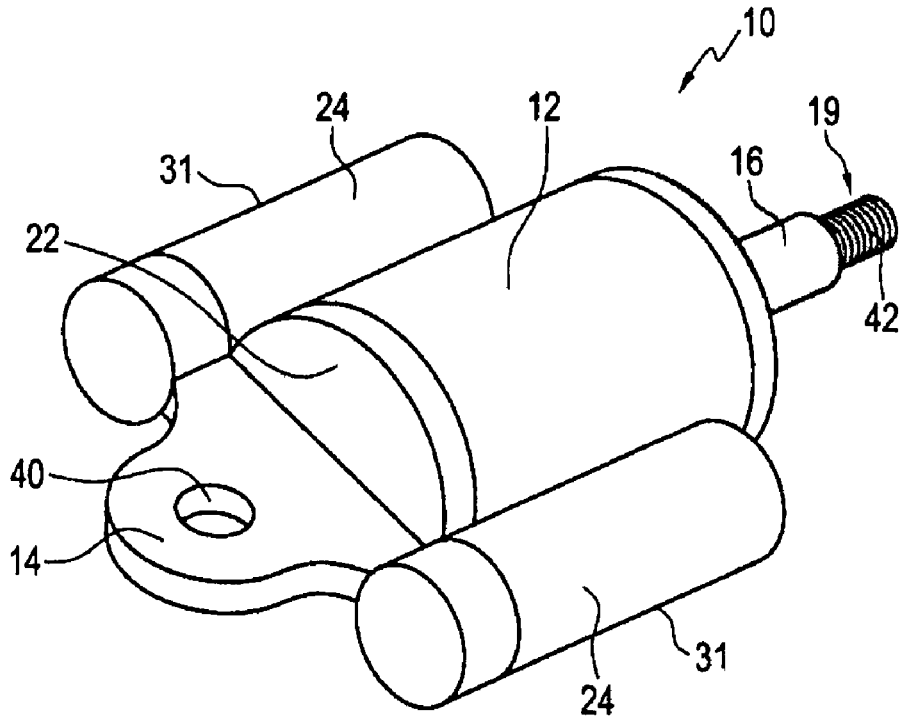
FIG. 2 is a top perspective view of the device show in FIG. 1.
Figure 3:
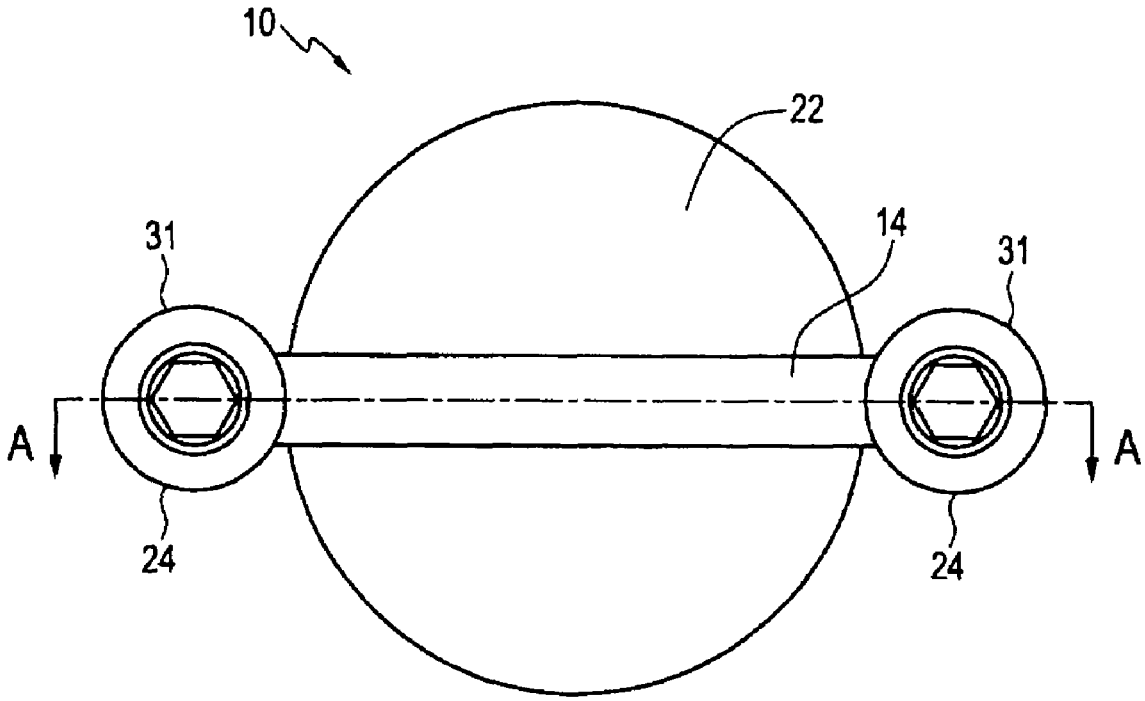
FIG. 3 is a top view of the device shown in FIG. 1.

FIGS. 1 and 2 are perspective views of a device 10 and FIG. 3 is a top view of the device 10, in accordance with the present invention. The device 10 comprises: a housing 12; a support frame 14; a shaft 16; a cover plate 22; and a pair of biasing mechanisms 24.

A drill string to be picked up or backed off is attached to device by attaching a polish rod to the threads 42 at a bottom end 19 of the shaft 16. A support system (not system) is connectable to an aperture 40 in the support frame 14.

Figure 4:
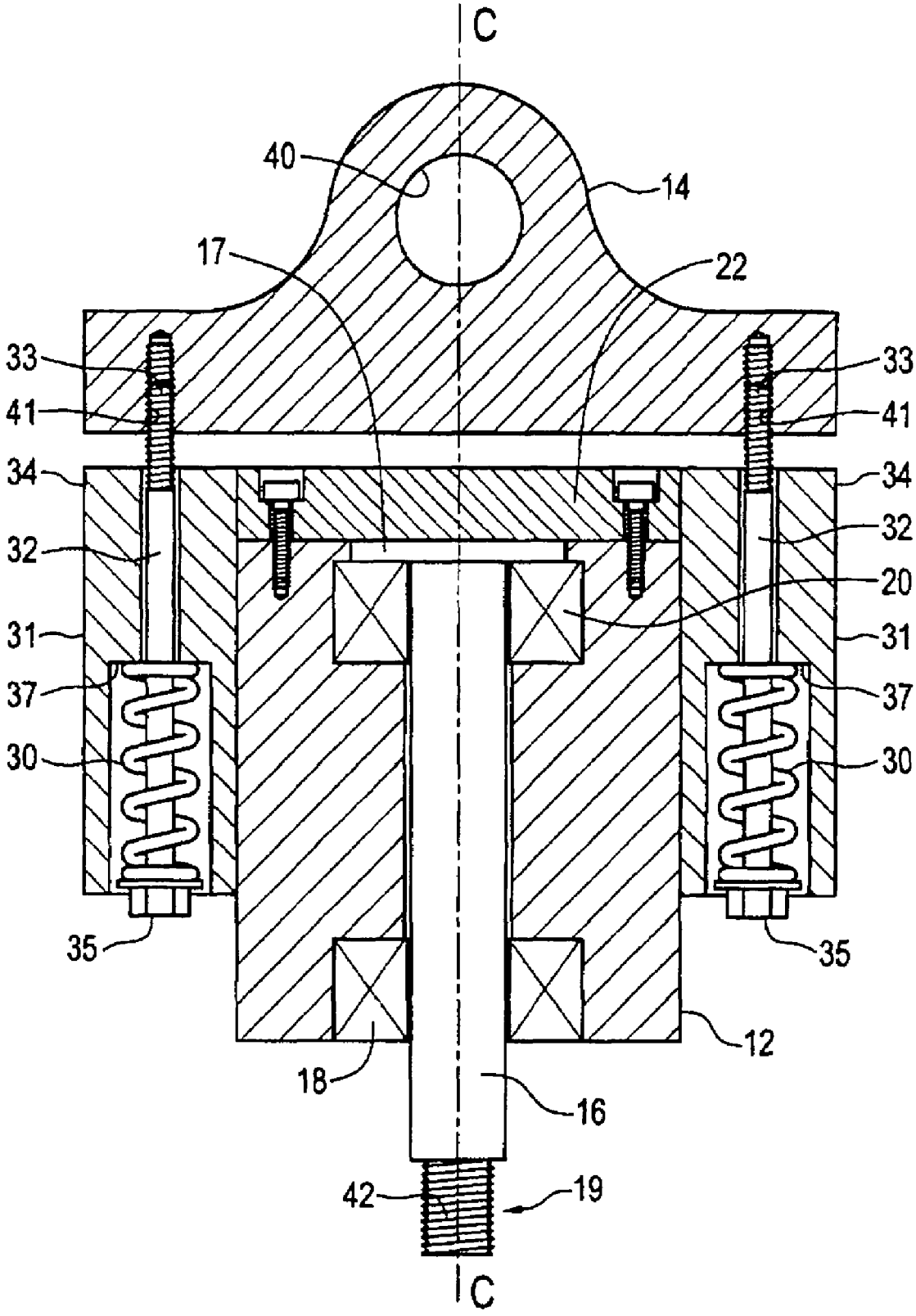
FIG. 4 is a side sectional view of the device shown in FIG. 1.

FIG. 4 is a sectional front view of the device 10 along line A-A of FIG. 3. The shaft 16 is supported in the housing 12 by a primary bearing 18 and a secondary bearing 20. Each biasing mechanism 24 comprises: a spring 30 and a structural bolt 32.

The shaft 16 is rotatably mounted inside the housing 12 using the primary bearing 18 and the secondary bearing 20. The primary bearing 18 and the secondary bearing 20 maintain the shaft 16 at an axis C of the device 10 and prevent radial motion of the shaft 16.

Typically, the primary bearing 18 is sized larger than the secondary bearing 20 in order to support the majority of the radial force placed on the primary bearing 18 and secondary bearing 20 by the shaft 16. The secondary bearing 20 predominantly supports a top end 17 of the shaft 16 and is typically also a thrust bearing to prevent axial movement of the shaft 16. In this manner, the primary bearing 18 and secondary bearing 20 allow the shaft 16 to rotate relative to the axis C but prevent radial and axial movement of the shaft 16 relative to the housing 12.

The biasing mechanisms 24 are positioned on either side of the housing 12 and allow the support frame 14 to move relative to the housing 12 along axis C. Each structural bolt 32 is provided with threads 33 that screw into mating threads 41 on the support frame 14 (either by having the mating threads 41 cut right into the support frame 14 or by using nuts). The other end 35 of the structural bolt 32 abuts the end of the spring 30. The other end 35 of the structural bolt 32 and spring 30 are housed within sleeves 31 connected to the housing 12. When a longitudinal downward force is applied along axis C, to the end 19 of the shaft 16, the shaft 16 places force on the secondary bearing 20, which is a thrust bearing, causing the housing 12 to displace downward with the shaft 16. Stops 37 push downwards on the tops of the springs 30, compressing the springs 30 positioned on the structural bolts 32 and allowing the housing 12 to move relative to the support frame 14. The biasing mechanisms 24 allows the housing 12 and the shaft 16 to be displaced along axis C, while the support frame 14 remains in substantially the same position along axis C.

When the housing 12 is no longer being forced downwards away from the support frame 12 by a downward force on the shaft 16, the tops of the springs 20 place an upwards force on the stops 37 moving the housing 12 back towards the support frame 12.

In operation with a rotary pump, when a drive string gets stuck and a drive unit rotating the drive string has stopped and released any built up torsional forces that it can by back spinning the drive string using a breaking system, the drive unit is disconnected from the polish rod connected to the drive string and the device 10 is attached to the end of the polish rod. The device 10 is connected to the polish rod by attaching the threaded end 42 of the shaft 16 to corresponding threads on the polish rod. The polish rod and attached drive string is then "picked up" by using some type of support structure to hoist up on the structural frame 14 of the device 14, which will in turn hoist up on the shaft 16, the polish rod and the drive string. The rotating shaft 16 allows the polish rod and attached drill string to release any built up torsional force by back spinning as the polish rod and drive string is picked up. The rotation of the shaft 16 along the centerline of the device 10 prevents the inducing of wobble by the rotating shaft 16. The biasing mechanisms 24 absorb vibrations and abrupt longitudinal motion of the drive string.

In operation with a rod pump, when a drive string gets stuck the threads 42 on the end 19 of the rotating shaft 16 are used to connect the shaft 16 of the device 10 to the polish rod. The threads 42 on the end 19 of the rotating shaft 16 can either be connected directly to the polish rod by corresponding threads or through the use of an adapter suitable to connect shaft 16 to the polish rod. The drive string and polish rod are then backed off using the device 10. Any rotation of the drive string that occurs during the backing off will be handled by the rotatable shaft 16 and the shock absorbing mechanism 34 will allow the drive string to be loaded progressively during the backing up and absorb any sudden longitudinal motion of the drive string.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A swivelling device for connection to a drive string, the device comprising:

a housing having an opening in a bottom end;

a shaft mounted within the housing and defining an axis, the shaft rotatably mounted within the housing and fixed longitudinally relative to the housing, a bottom end of the shaft passing through the opening in the bottom end of the housing and connectable to a drive string with no point of articulation between the shaft and the drive string;

a support frame connectable to an external support, the support frame moveably connected to the housing such that the housing can be longitudinally displaced, along the axis, away from the support frame and such that the support frame and housing are rotationally fixed with respect to each other to prevent relative rotation about the axis; and at least one biasing mechanism biasing the housing towards the support frame.

2. The swivelling device of claim 1 wherein each biasing mechanism comprises a spring.

3. The swivelling device of claim 2 wherein there are two biasing mechanisms and the biasing mechanisms are positioned on substantially opposing sides of the housing.

4. The swivelling device of claim 1 wherein each biasing mechanism comprises a coil spring surrounding a structural bolt and positioned within a sleeve attached to an outside surface of the housing, each coil spring provided at a first end of the structural bolt and a second end of the structural bolt is connected to the support frame, whereby when the housing is displaced away from the support frame, the coils springs are compressed in the sleeves.

5. The swivelling device of claim 1 wherein the shaft is mounted within the housing using a first bearing and a second bearing, the first bearing positioned towards the bottom end of the housing and suitable to support a radial load imposed on the first bearing by the shaft, the second bearing being a thrust bearing and positioned at a top end of the shaft and suitable to support an axial load imposed on the second bearing by the shaft and prevent the shaft from moving longitudinally relative to the housing.

6. The swivelling device of claim 2 wherein the bottom end of the shaft connects to a drive string using a threaded connection.

7. The swivelling device of claim 6 wherein the threaded connection is a male screw thread fitting and operative to attach to a screw thread fitting.

8. A swivelling device for connection to a drive string, the device comprising:

a housing having an opening in a bottom end;

a shaft mounted within the housing using a first bearing and a second bearing and defining an axis, the first bearing positioned towards the bottom end of the housing and suitable to support a radial load imposed on the first bearing by the shaft, the second bearing being a thrust bearing and positioned at a top end of the shaft preventing downward motion of the shaft relative to the second bearing such that downward motion of the shaft causes the housing to move downwards in conjunction with the shaft, a bottom end of the shaft passing through the opening in the bottom end of the housing and connectable to a drive string with no point of articulation between the shaft and the drive string;

a support frame connectable to an external support, the support frame moveably connected to the housing such that the housing can be longitudinally displaced, along the axis, away from the support frame and such that the support frame and housing are rotationally fixed with respect to each other to prevent relative rotation about the axis; and at least two biasing mechanisms biasing the housing towards the support frame, the two biasing mechanisms positioned on substantially opposing sides of the housing.

9. A swivelling device for connection to a drive string, the device comprising:

a housing having an opening in a bottom end;

a shaft mounted within the housing and defining an axis, the shaft rotatably mounted within the housing and fixed longitudinally relative to the housing, a bottom end of the shaft passing through the opening in the bottom end of the housing and connectable to a drive string with no point of articulation between the shaft and the drive string;

a support frame connectable to an external support, the support frame moveably connected to the housing such that the housing can be longitudinally displaced, along the axis, away from the support frame and such that the support frame and housing are rotationally fixed with respect to each other to prevent relative rotation about the axis; and at least two coil springs, each coil spring positioned within a sleeve connected an outside surface of the housing and biasing the housing towards the support frame.

10. The swivelling device of claim 9 wherein the two coil springs are positioned on substantially opposing sides of the housing.

11. The swivelling device of claim 9 wherein each coil spring surrounds a structural bolt and is positioned within a sleeve attached to an outside surface of the housing, each coil spring provided at a first end of the structural bolt and a second end of the structural bolt is connected to the support frame, whereby when the housing is displaced away from the support frame, the coils springs are compressed in the sleeves.

* * * * *